United States Patent [19]

Caspall

[11] Patent Number: 4,723,582

[45] Date of Patent: Feb. 9, 1988

[54] METHOD OF MAKING AN ANTISLIP WOODEN HANDLE FOR A HAND-HELD STRIKING TOOL

[75] Inventor: Danny R. Caspall, Walnut Ridge, Ark.

[73] Assignee: Vaughan & Bushnell Mfg. Co., Hebron, Ill.

[21] Appl. No.: 759,450

[22] Filed: Jul. 26, 1985

[51] Int. Cl.[4] ..... B27M 1/00

[52] U.S. Cl. ..... 144/358; 101/31; 101/32; 81/20; 81/177.1

[58] Field of Search ..... 81/20, 19, 177.1, 489; 144/197, 358, 380; 101/21, 27, 28, 31, 32

[56] References Cited

U.S. PATENT DOCUMENTS

| | | | |
|---|---|---|---|
| 28,230 | 2/1898 | Swan | 81/177.1 |
| 2,340,619 | 2/1944 | Schwarzmayr | 81/20 |
| 3,088,506 | 5/1963 | Bianchini | 81/19 |
| 3,229,401 | 1/1966 | Sobran | 144/358 |
| 4,007,767 | 2/1977 | Colledge | 144/358 |

*Primary Examiner*—Frederick R. Schmidt
*Assistant Examiner*—Bradley I. Vaught
*Attorney, Agent, or Firm*—Gerlach & O'Brien

[57] ABSTRACT

An anti-slip wooden handle for a hand-held striking tool, and a method of making the same, embody the provision in the handle of grooves formed in a gripping surface by die-pressing at high temperature, so as to minimize slipping of the handle when in use, while also minimizing hand irritation.

6 Claims, 4 Drawing Figures

METHOD OF MAKING AN ANTISLIP WOODEN HANDLE FOR A HAND-HELD STRIKING TOOL

BACKGROUND OF THE INVENTION

This invention relates to wooden handles for hand-held striking tools, particularly, to anti-slip wooden handles, especially hammer handles.

The user of a hammer or other hand-held striking tool desires that it be comfortable in use. The characteristics of the handle can contribute materially to comfort by, e.g., minimizing the transmission of vibration to the hand upon striking an object with the hammerhead.

Three materials commonly are used in hammer handles, namely, metal, fiberglass-reinforced plastic ("fiberglass"), and wood. The vibration-absorbing quality of metal and fiberglass is poor, so that they transmit vibrations relatively readily. To improve their vibration-absorbance, metal and fiberglass handles often are supplied commercially with rubber sheaths fitted over their gripping portions. Rubber sheaths also improve the anti-slip properties of the gripping portions. In some instances, these properties are further improved by providing holes or grooves in the surface of the sheaths.

Nevertheless, many carpenters and other craftsmen prefer plain wooden handles to those made of metal/-rubber or fiberglass/rubber. Plain wood is perceived by them as being superior in vibration absorbance to handles made of the other-named materials, especially when the tools are used routinely for long periods of time.

Conventional wooden handles are smooth, so that the gripping portion of the handle affords relatively low frictional resistance to hand movement, or is relatively slippery, especially when aggravated by a film of perspiration from the hand. Economic reasons preclude manufacturers from improving the anti-slip properties of wooden handles by fitting them with the relatively expensive rubber sheaths, which, as a practical matter, are not reusable.

In the past, manufacturers of hammers with plain wooden handles have modified the surface of the gripping portions of the handles in several different ways to improve their slip resistance. Roughening coatings containing particulate matter have been applied to the gripping portion. A number of holes have been drilled into the surface of the gripping portion, or encircling grooves have been lathe-cut in the gripping portion. The modifications increase the roughness or friction afforded by the gripping portion, and, particularly in the case of the holes or grooves, provide reservoirs into which perspiration can drain from the surface of the gripping portion. However, they also increase the propensity of the handle to chafe or irritate the hand during use of the hammer.

A contributing factor in the case of the holes or grooves in the wooden handles is the presence of rough, broken, torn, or frayed wood fibers on the gripping portion at the edges of the holes or grooves. The broken fibers are a natural consequence of the drilling or lathe-cutting operations. Therefore, handles commercially modified in such ways are commonly employed only for a specialized procedure, such as where the tool generally is used only for short periods of time, and/or where the greatest possible anti-slip resistance is required because the slipperiness of the handle, or of the hand of the user, is increased by exposure to grease or oil.

Individual craftsmen in the past have modified the handles of their personal tools in ways similar to those used commercially, by drilling holes in the gripping portion, or by filing, grinding, or cutting grooves therein. Handles so modified also suffer from the irritation problems caused by rough, broken or severed fibers at the edges of the holes or grooves.

SUMMARY OF THE INVENTION

The present invention provides an anti-slip wooden handle for a striking tool, and a method of making the same, that overcome the disadvantages of the prior art handles and methods. In particular, a wooden handle is provided in which spaced-apart grooves are formed in a gripping surface by die-pressing at high temperature, so as to minimize slipping of the handle when in use, while also minimizing hand irritation.

More particularly, the invention provides an improvement in a wooden handle for a hand-held striking tool, such handle including a gripping portion having a substantially elliptical cross-sectional configuration providing a pair of opposed relatively wide gripping surfaces and a pair of opposed relatively narrow gripping surfaces, the improvement comprising a plurality of spaced-apart grooves formed in a relatively wide gripping surface by die-pressing at a die temperature of at least about 550° F., preferably about 550° F. to 1000° F., for minimizing slipping of the handle in the hand during use of the tool.

The handle provided with such grooves, in general, is free of abrasiveness and splinter formation, so that hand irritation is minimized, while being gripped securely and with minimal slippage, owing to enhanced frictional engagement with the hand.

Manufacture of the new handle is simple, economical and reliable, requiring only conventional die-press equipment for forming the handle grooves.

BRIEF DESCRIPTION OF THE DRAWINGS

The drawings illustrate a preferred embodiment of the anti-slip wooden handle of the invention, without limitation thereto. In the drawings, like elements are identified by like reference symbols in each of the views, and.

DESCRIPTION OF THE PREFERRED EMBODIMENT

Figure 1:
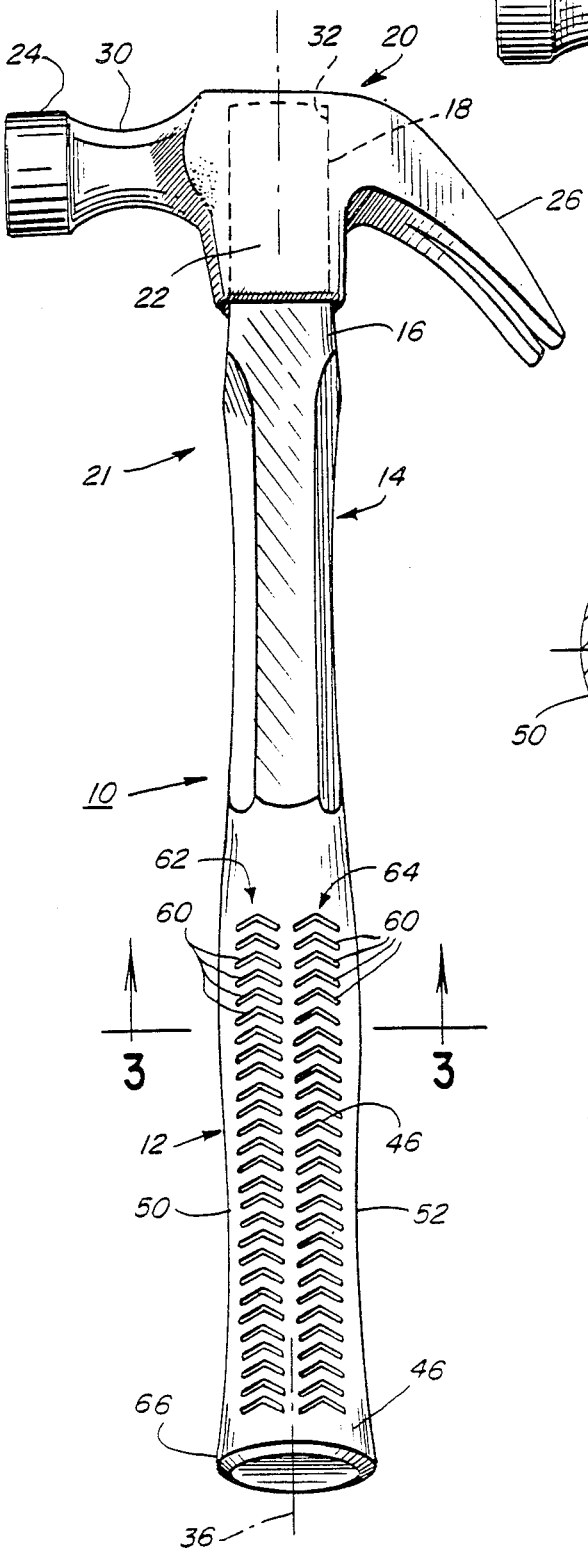
FIG. 1 is a perspective view of a wooden handle constructed in accordance with the invention and shown fitted with a carpenter's claw hammer head.

Referring to the drawings, particularly FIG. 1, as wooden handle 10 constructed in accordance with the invention includes a proximal gripping portion or grip 12 and, successively more distal thereto, a spring portion or spring 14, a shoulder portion 16, and an eye portion 18. The illustrative handle 10 is fitted with a carpenter's claw hammer head 20, to provide a complete claw hammer 21.

Figure 2:
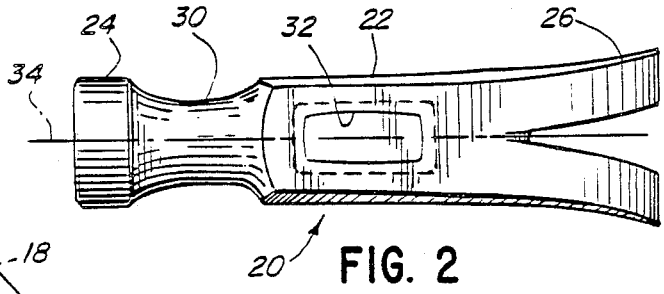
FIG. 2 is an end elevational view of the hammerhead illustrated in FIG. 1.
Figure 3:
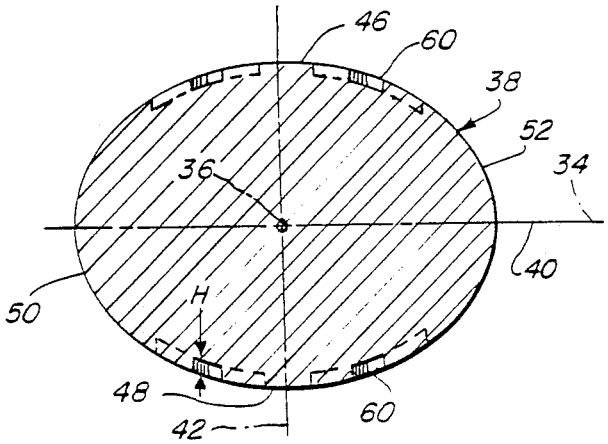
FIG. 3 is an enlarged cross-sectional view of the handle of FIG. 1, taken substantially on line 3—3 thereof.

Referring to FIGS. 1-3, the illustrative hammerhead 20 is of conventional form and construction, and it includes a medial body portion or region 22 and, projecting outwardly from opposite ends thereof, a forwardly extending impact head 24 and a rearwardly extending claw portion 26. The impact head 24 is joined to the medial body portion 22 by a constricted neck portion 30 of polygonal cross section. A generally rectangular socket or opening 32 extends transversely through the body portion 22.

The eye portion 18 of the handle 10 is substantially rectangular in cross section, and is dimensioned to fit snugly in the socket 32 of the hammerhead 20, where it is secured by wedges (not shown). The spring portion 14 of the handle 10 is substantially octagonal in cross section. The shoulder portion 16 of the handle, which interconnects the spring and eye portions 14 and 18, has a cross section that changes from substantially octagonal at a location adjacent to the spring portion 14, to substantially rectangular at a location adjacent to the eye portion 18.

The gripping portion 12 is substantially elliptical in cross section, the dimensions of which vary along the length of the portion, owing to a slight longitudinal curvature therein. The spring portion 14 merges into the gripping portion 12 at a location intermediate the opposite ends of the handle 10. At this location, the cross section of the handle 10 changes from the substantially octagonal contour of the spring portion 14 to the substantially elliptical contour of the gripping portion 12.

The hammerhead 20 and the handle 10, and thus the entire hammer 21, are symmetrical about a plane 34 extending through the longitudinal axis 36 of the handle and centrally through the hammerhead from the impact head 24 to the claw portion 26. Referring to FIG. 3, a representative cross section of the gripping portion 12 is defined by an ellipse 38 having a major axis 40 and a minor axis 42. The major axis 40 lies in the plane of symmetry 34. Opposite relatively wide surfaces 46 and 48 of the gripping portion, having a lesser degree of curvature, are opposed to the major axis 40. Opposite relatively narrow surfaces 50 and 52, having a greater degree of curvature, are opposed to the minor axis 42. Hence, the wide surfaces 46 and 48 lie on opposite sides of the plane of symmetry 34, and the narrow surfaces 50 and 52 are bisected by such plane.

Figure 4:
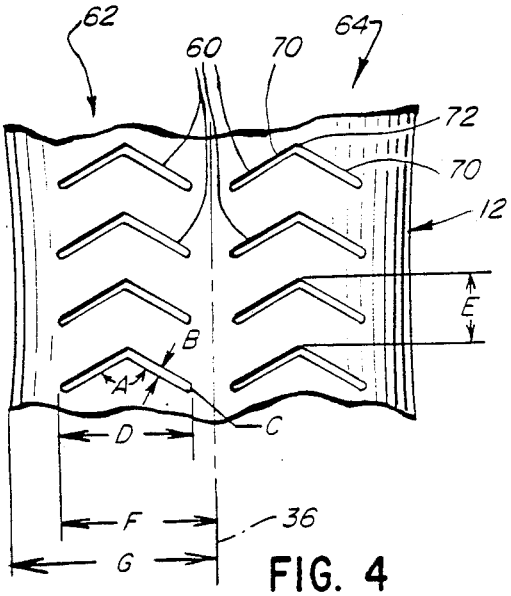
FIG. 4 is an enlarged fragmentary elevational view of the gripping portion of the handle of FIG. 1.

Referring to FIGS. 1 and 4, a plurality of spaced-apart grooves or indentations 60 is provided in each of the opposite wide gripping portion surfaces 46 and 48 of lesser curvature. Each groove 60 in the illustrative preferred embodiment is formed in the shape of a chevron comprising two diagonal leg portions 70 intersecting at their inner ends to form an apex 72 pointing toward the hammerhead 20. The grooves 60 extend in two parallel longitudinal rows 62 and 64 of substantially parallel grooves 60, on each of the wide surfaces 46 and 48. The rows 62 and 64 of grooves extend from a location adjacent to the butt or proximal end portion 66 of the handle 12, to a location adjacent to the spring portion 14 thereof.

In accordance with the invention, it has been found that by forming the grooves 60 by die-pressing at a die temperature of at least about 550° F., the handle 10 is provided with a degree of roughness suitable for minimizing slipping in the hand, without accompanying hand irritation, such as occasioned by abrasive wood fiber ends and splintering. Achievement of the desired results is owing to the nature of the phenomena occurring above such temperature, of burning and "vaporization" of the wood fibers, and possibly other phenomena, which render the fibers non-abrasive and not prone to splintering at the margins of the grooves. On the other hand, die-pressing below such temperature results in abrasiveness and splintering tendencies, apparently due to fiber breakage.

In general, the die temperature preferably is in the range of about 550° F. to 1000° F. The temperature selected is dependent upon whether the handle 10 in which grooves are to be provided has been treated in some manner, such as by staining, before die-pressing. Thus, for previously-stained handles 10, it is preferred that the dies be heated to a temperature of about 550° F. to about 900° F., more preferably, about 850° F., for minimal discoloration. For untreated handles 10, the preferred temperature range is about 550° F. to about 1000° F., more preferably, about 950° F. The higher temperatures may be employed with shorter dwell times, in order to increase productivity. Above about 1000° F., excessive charring of the wood may result, with consequent roughness and undesirable discoloration.

The grooves 60 are formed in the opposite wide surfaces 46 and 48 of the gripping portion 12 by a die-pressing, or hot-stamping, method, wherein heated dies are pressed against the opposite surfaces. The dies are provided with raised portions complementary in shape to the desired grooves 60, and having outer end surfaces, which face the handle surfaces 46 and 48, curved complementarily to the curvature of the handle surfaces. Consequently, under optimum conditions, the impressed depth "H" of a groove 60 (FIG. 3) is substantially constant throughout the span "D" (FIG. 4) thereof.

The dies are provided with a source of controllable heat, such as a thermostatically regulated electrical heating element, and are mounted on a conventional hydraulic press, such as the Neff Power Inc. (St. Louis, Mo.) Model D-24. The press is provided with mechanisms for controlling dwell time and applied pressure. One die is mounted on the press bench and the other in the press ram.

Undesired heating or burning of the areas of the handle surfaces 46 and 48 around the grooves 60 is prevented by dimensioning the dies in such manner that the outermost surfaces of the die projection are spaced a distance away from the cut-away or base surfaces of the dies from which the projections extend, that is greater than the desired depth of the grooves 60. Then, when the projections are pressed into the handle surfaces 46 and 48 to form grooves of the desired depth, no heated portion of the dies will contact any of the surfaces around the grooves.

The method parameters of die temperature, die pressure, and die dwell time are interrelated. As die temperature is raised, the die pressure and dwell time required to produce satisfactory grooves 60 are reduced. In general, preferred conditions include the above-described die temperature range of about 550° F. to 1000° F., a die pressure of about 1200–9300 pounds per square inch, and a die dwell time of about 0.5 to 3.5 seconds.

Optimum conditions for the production of acceptable grooves 60 are determined empirically. Sufficient pressure is employed at a given die temperature to compensate for slight irregularities in the contour or dimensions of a handle 10 thereby to ensure that the depths "H" of the chevrons 60 impressed both in the higher-lying and lower-lying areas of the gripping portion 12 are within the below-described preferred range. For example, the handle 10 desirably may be made by die-pressing in the above-identified press of Neff Power Inc., a stained hickory wood handle for a claw hammer, at a die temperature of about 850° F., a die pressure of about 1200–4000 pounds per inch, and a die dwell time of about 2.5 seconds. It is preferred to lightly buff the handle 10 after the diepressing operation, to round off the edges of the grooves, which are generally right-angled and may be somewhat sharp.

The dimensions, spacing, and number of grooves 60 are determined experimentally to provide a gripping portion 12 having a good "texture,"i.e., providing a maximum of slip resistance and a minimum of hand irritation. To attain the desired texture, the depth "H" of a groove 60 (FIG. 3) preferably is about 1/64 to 3/64 inch, more preferably, about 1/32 inch. Groove depths greater than about 3/64 inch may cause hand irritation during extended use of the hammer 21 and also may give rise to problems in manufacture. The width "B" of a leg 70 of a groove 60 preferably is about 1/64 to 1/8 inch, more preferably, about 1/32 inch. Widths "B" substantially in excess of ⅛ inch may result in hand irritation.

It is preferred that the grooves 60 be provided only in the wide surfaces 46 and 48 of the handle 10, and that the narrow surfaces 50 and 52 of the handle be made substantially smooth and even. When the handle 10 is gripped by the hand in the customary manner used when hammering a nail, the grooved wide surfaces 46 and 48 are in contact with, respectively, the inner surfaces of the fintertips and of the base of the fingers, increasing friction and reducing slippage therebetween. The smooth narrow surfaces 50 and 52 are in contact with the inner surfaces of the medial portions of the fingers and of the palm, respectively. Craftsmen may prefer a slightly loose hold, for "flicking" the wrist when driving a nail, with a resulting slight movement of the handle relative to the hand, that imparts a snap or acceleration to the hammerhead. The smooth surfaces 50 and 52 minimize the friction, and possible irritation of the hand, especially the palm, that results from such relative movement.

Referring to FIG. 4, exemplary dimensions respecting the grooves 60 in the illustrative embodiment are: Angle "A" included between the legs 70, 120°; groove width "B" between opposite side walls of a leg 70, 1/32 inch; radius of curvature "C" of the outer end of a leg 70, 1/64 inch; distance "D" of the span of a groove 60, 7/16 inch; longitudinal distance "E" between apices of longitudinally adjacent grooves 60, 0.18 inch; distance "F" between the longitudinal axis 36 of the handle 10 and the outer end of a groove 60, ½ inch. The distance "G" between the axis 36 and the lateral margin of the gripping portion 12 varies from about ⅝ inch to about ¾ inch. Referring to FIG. 3, the depth "H" of a groove 60 is 1/32 inch. It is to be noted that the dimensions may vary somewhat from the foregoing dimensions, in production.

The handle of the invention is useful in various hand-held portable striking tools, including, in addition to the illustrative claw hammer, other hammers, hatchets, and the like. While a preferred embodiment of the handle and of a hammer incorporating the same have been described and illustrated, it will be apparent to those skilled in the art that various changes and modifications may be made therein, within the spirit and the scope of the invention. It is intended that all such changes and modifications be included within the scope of the appended claims.

I claim:

1. In a method of making a wooden handle for a hand-held striking tool, said handle including a gripping portion having a substantially elliptical cross-sectional configuration providing a pair of opposed relatively wide gripping surfaces and a pair of opposed relatively narrow gripping surfaces, the improvement comprising die-pressing a plurality of spaced-apart non-intersecting grooves into a relatively wide gripping surface, said grooves having a width of about 1/64 to 1/32 inch and a depth of about 1/64 to 3/64 inch, for minimizing slipping of the handle in the hand during use of the tool, said die-pressing taking place at a die temperature of about 550° F. to 1000° F. and a die pressure of about 1200 to 9300 pounds per square inch to provide grooves substantially free of abrasiveness and splinter formation.

2. A method as defined in claim 1 wherein said grooves are formed in a longitudinal row of spaced-apart substantially parallel grooves in each of said relatively wide gripping surfaces.

3. A method as defined in claim 2 wherein said grooves are chevron-shaped.

4. A method as defined in claim 1 wherein said die temperature is about 850° F. to 950° F.

5. In a method of making a wooden hand-held hammer handle including a gripping portion having a substantially elliptical cross-sectional configuration providing a pair of opposed relatively wide gripping surfaces and a pair of opposed relatively narrow gripping surfaces, the improvement comprising die pressing a plurality of non-intersecting grooves including a longitudinal row of spaced-apart substantially parallel grooves into each of the relatively wide gripping surfaces, said grooves having a width of about 1/32 inch and a depth of about 1/32 inch for minimizing slipping of the handle in the hand during use of the tool, said die-pressing taking place at a die temperature of about 850° F. to 950° F. and a die pressure of about 1200 to 4000 pounds per square inch to provide grooves substantially free of abrasiveness and splinter formation.

6. A method as defined in claim 5 wherein said grooves are chevron-shaped.

* * * * *